US012723469B2

(12) United States Patent
Lyon

(10) Patent No.: US 12,723,469 B2
(45) Date of Patent: Sep. 1, 2026

(54) DOWN-THE-HOLE DRILL HAMMER HAVING A PISTON FOLLOWER VALVE

(71) Applicant: Center Rock Inc., Berlin, PA (US)

(72) Inventor: Leland H. Lyon, Roanoke, VA (US)

(73) Assignee: Center Rock Inc., Berlin, PA (US)

( * ) Notice: Subject to any disclaimer, the term of this patent is extended or adjusted under 35 U.S.C. 154(b) by 48 days.

(21) Appl. No.: 18/423,787

(22) Filed: Jan. 26, 2024

(65) Prior Publication Data

US 2024/0254860 A1 Aug. 1, 2024

Related U.S. Application Data

(60) Provisional application No. 63/482,647, filed on Feb. 1, 2023.

(51) Int. Cl.
*E21B 4/14* (2006.01)
*E21B 34/10* (2006.01)

(52) U.S. Cl.
CPC ..... *E21B 4/14* (2013.01); *E21B 34/10* (2013.01)

(58) Field of Classification Search
CPC ..... E21B 4/14; E21B 34/10
See application file for complete search history.

(56) References Cited

U.S. PATENT DOCUMENTS 2,661,928 A * 12/1953 Topanelian, Jr. ..... E21B 4/14 173/66
2,851,251 A * 9/1958 Mori ..... E21B 4/14 91/170 R
2,979,033 A * 4/1961 Bassinger ..... E21B 4/14 175/100
3,095,047 A * 6/1963 Fleischer ..... E21B 4/14 173/16
4,194,435 A * 3/1980 Gaun ..... E21B 4/145 91/468
4,878,550 A * 11/1989 Chuang ..... E21B 4/14 91/218
2012/0006598 A1* 1/2012 Lyon ..... E21B 4/14 175/296

* cited by examiner

*Primary Examiner* — D. Andrews
(74) *Attorney, Agent, or Firm* — Kim IP Law Group LLC

(57) ABSTRACT

A down-the-hole drill hammer including a drill bit about a distal end of the hammer and a piston for percussively contacting the drill bit. The drill hammer further includes a valve assembly for supplying and exhausting drive fluid to and from the piston, the valve assembly having a valve housing in fluid communication with drive fluid supply ports, drive ports and exhaust ports, and a control valve movable within the valve housing and in fluid communication with the valve housing. The drill hammer further includes a piston follower valve unconnected to the piston movable within the control valve for controlling positioning of the control valve and pressures applied to the piston via the drive ports and exhaust ports.

19 Claims, 12 Drawing Sheets

DOWN-THE-HOLE DRILL HAMMER HAVING A PISTON FOLLOWER VALVE

CROSS-REFERENCE TO RELATED APPLICATION

This application claims the benefit under 35 U.S.C. § 119(e) to U.S. Provisional Application No. 63/482,647, filed Feb. 1, 2023, and entitled "Down-The-Hole Drill Hammer Having A Piston Follower Valve," the entire disclosure of which is hereby incorporated by reference for all purposes.

BACKGROUND

Virtually all hydraulic rock drilling tools use a piston for providing a mechanical impulse to a rock breaking tool and a control valve which redirects fluid flow to cause the piston to oscillate to and from the tool. The means with which to couple piston position to the control valve is a critical design feature. The most common prior art includes piston ports which direct fluid pressure to and from a valve control surface. This form of control can be problematic as porting surfaces are usually large in diameter to enclose the piston which causes excessive leakage, and mechanical shock from the impulse can cause lateral motion and component wear at the porting interfaces. Additionally, in downhole applications the piston and valve must fit within a confined diameter as determined by the hole being drilled. Valves which enclose the piston consume precious radial space.

SUMMARY OF THE DISCLOSURE

According to an exemplary embodiment, the subject disclosure relates to a down-the-hole drill hammer including a drill bit about a distal end of the drill hammer and a piston for percussively contacting the drill bit. The down-the-hole drill hammer comprises: a drill bit; a piston for percussively contacting the drill bit; a valve assembly for controlling the supply of drive fluid to and from the piston, the valve assembly comprising: a piston follower valve moveable within the valve assembly independently from the piston.

According to another aspect, the valve assembly further includes: a valve housing; and a control valve moveable within the valve housing. The valve housing is mounted within a valve control area and the control valve and piston follower valve are each movable relative to the valve housing. The piston follower valve is moveable relative to the control valve. The valve housing includes galleries configured for fluid communication with supply ports, drive ports and/or exhaust ports. The valve housing includes a central through hole having a proximal end portion and a distal end portion, and wherein the distal end portion has a larger internal diameter than an internal diameter of the proximal end portion. The valve housing includes a plurality of galleries along its outer surface in fluid communication with an internal central through hole. The valve housing includes at least three through holes spaced apart in a longitudinal direction along a longitudinal length of the valve housing. The valve housing includes a proximal end portion having a substantially pentagram-shaped cross-section. The control valve includes galleries configured for fluid communication with the valve housing galleries. The control valve includes a first gallery and a second gallery spaced from the first gallery. The control valve includes a longitudinal through hole coaxial with a longitudinal axis of the control valve. The control valve includes a distal end face having an overall diameter larger than a proximal end face. The piston follower valve is movable relative to the piston. The piston follower valve is movable relative to the valve housing and the control valve. The piston follower valve is a cylindrical valve. The piston follower valve includes a first annular portion occluded at about a midportion via an occlusion and a second annular portion. The first annular portion includes a plurality of slots circumferentially spaced apart and in fluid communication with an interior of the first annular portion. The piston follower valve is movable between a first position wherein the plurality of slots is occluded and second position wherein the plurality of slots are not occlude and in fluid communication an external of the piston follower valve. The second annular portion includes a plurality of through holes circumferentially spaced apart and in fluid communication with an interior of the second annular portion. The piston follower valve is movable between a first position wherein the plurality of through holes is occluded and second position wherein the plurality of through holes are not occlude and in fluid communication an external of the piston follower valve.

In accordance with another exemplary embodiment, the present disclosure provides for a valve assembly for a down-the-hole drill hammer comprising: a valve housing; a control valve mounted within and movable relative to the valve housing; and a piston follower valve moveable relative to the valve housing and control valve.

Generally, the subject disclosure relates to a downhole drill having a piston follower design in which the valve porting is coupled to the piston position with a follower stem. This stem is also positioned axially above the piston and does not consume radial space beyond that required by the piston.

In an exemplary embodiment the piston follower valve (PFV) control is used in a hydraulic down-the-hole drill intended to operate on high pressure (e.g., 2000 psi) hydraulic fluid such as, e.g., water. The PFV is pressurized in a manner such that it follows piston motion and provides a small portion of a constant downward (toward impact) force. A control valve has two oppositely facing areas (a constant supply area and a larger control area) and volumes that control its motion. The control area is ported by the PFV along an inner bore of the valve cyclically between high pressure and low pressure as the PFV follows the piston motion up and down.

Other features and advantages of the subject disclosure will be apparent from the following more detailed description of the exemplary embodiments.

BRIEF DESCRIPTION OF THE SEVERAL VIEWS OF THE DRAWINGS

The foregoing summary, as well as the following detailed description of the exemplary embodiments of the subject disclosure, will be better understood when read in conjunction with the appended drawings. For the purpose of illustrating the present disclosure, there are shown in the drawings exemplary embodiments. It should be understood, however, that the subject application is not limited to the precise arrangements and instrumentalities shown.

DETAILED DESCRIPTION

Figure 1:
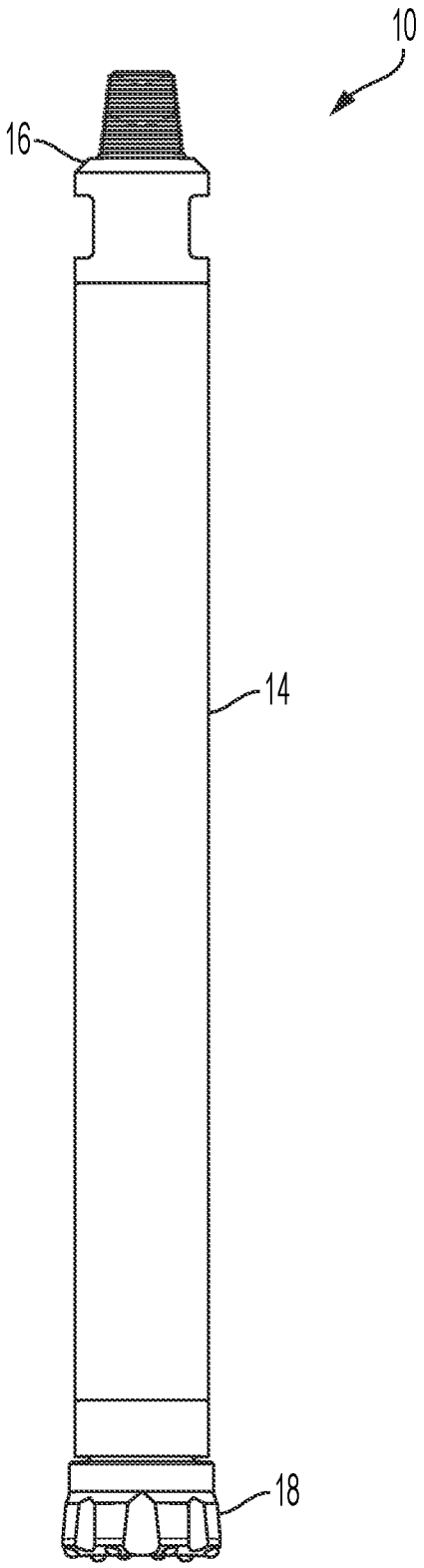
FIG. 1 is an elevational view of a down-the-hole-drill hammer in accordance with an exemplary embodiment of the subject disclosure.

Reference will now be made in detail to the various exemplary embodiments of the subject disclosure illustrated in the accompanying drawings. Wherever possible, the same or like reference numbers will be used throughout the drawings to refer to the same or like features. It should be noted that the drawings are in simplified form and are not drawn to precise scale. Certain terminology is used in the following description for convenience only and is not limiting. Directional terms such as top, bottom, left, right, above, below and diagonal, are used with respect to the accompanying drawings. The term "distal" shall mean away from the center of a body. The term "proximal" shall mean closer towards the center of a body and/or away from the "distal" end. The words "inwardly" and "outwardly" refer to directions toward and away from, respectively, the geometric center of the identified element and designated parts thereof. Such directional terms used in conjunction with the following description of the drawings should not be construed to limit the scope of the subject disclosure in any manner not explicitly set forth. Additionally, the term "a," as used in the specification, means "at least one." The terminology includes the words above specifically mentioned, derivatives thereof, and words of similar import.

"About" as used herein when referring to a measurable value such as an amount, a temporal duration, and the like, is meant to encompass variations of ±20%, ±10%, ±5%, ±1%, or ±0.1% from the specified value, as such variations are appropriate.

"Substantially" as used herein shall mean considerable in extent, largely but not wholly that which is specified, or an appropriate variation therefrom as is acceptable within the field of art. "Exemplary" as used herein shall mean serving as an example.

Throughout this disclosure, various aspects of the subject disclosure can be presented in a range format. It should be understood that the description in range format is merely for convenience and brevity and should not be construed as an inflexible limitation on the scope of the subject disclosure. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 2.7, 3, 4, 5, 5.3, and 6. This applies regardless of the breadth of the range.

Furthermore, the described features, advantages, and characteristics of the exemplary embodiments of the subject disclosure may be combined in any suitable manner in one or more embodiments. One skilled in the relevant art will recognize, in light of the description herein, that the present disclosure can be practiced without one or more of the specific features or advantages of a particular exemplary embodiment. In other instances, additional features and advantages may be recognized in certain embodiments that may not be present in all exemplary embodiments of the subject disclosure.

Figure 2:
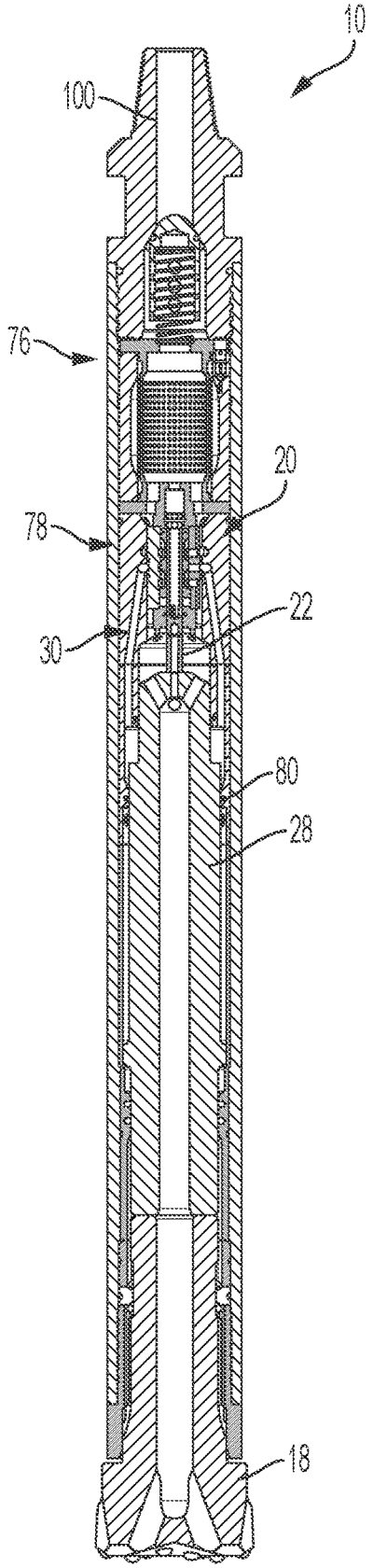
FIG. 2 is an elevational cross-sectional view of the down-the-hole-drill hammer of FIG. 1.
Figure 3:
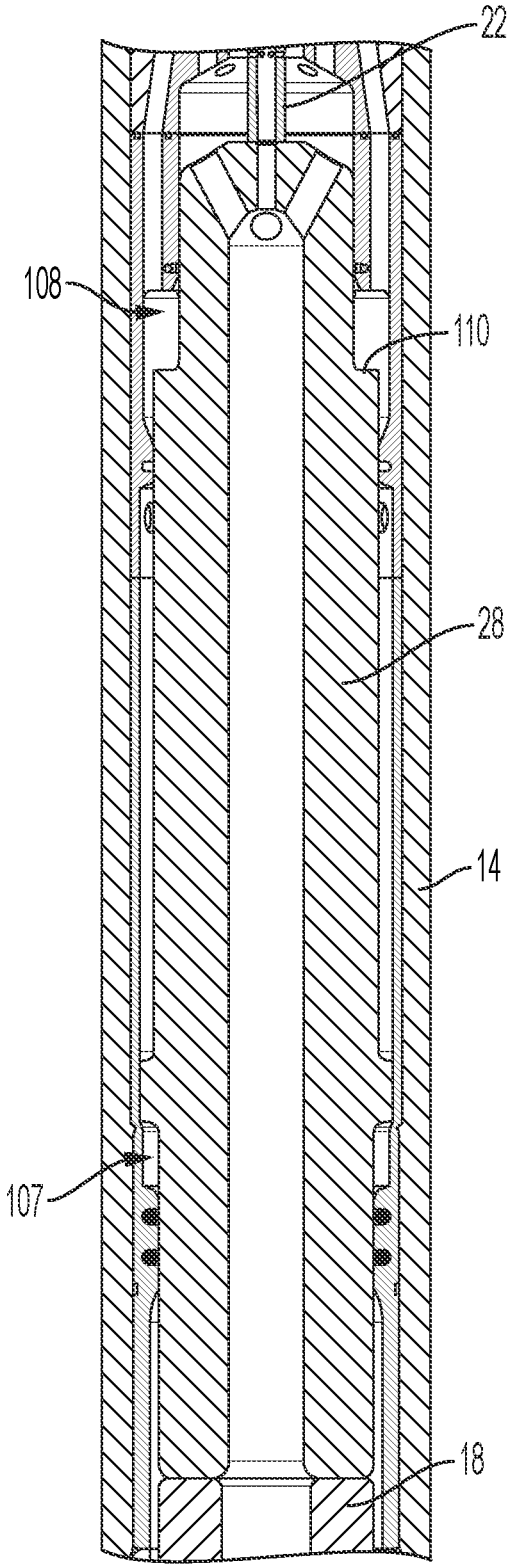
FIG. 3 is an enlarged cross-sectional view of a portion of the down-the-hole-drill hammer of FIG. 1.

Referring to FIGS. 1-12, in accordance with an exemplary embodiment, the present disclosure provides a down-the-hole (DTH) drill hammer 10 including a housing 14, a back head 16 for connection to a drill string, and a drill bit 18 about a distal end of the hammer. FIG. 2 is a longitudinal cross-section of the drill hammer 10 illustrating the various internal components of the drill hammer. The drill hammer further includes a control valve assembly or valve assembly 20 having piston follower valve (PFV) 22, a valve housing 24, and a control valve 26. The valve assembly 20 operates to drive the operations of the drill hammer's piston 28 for percussively driving the piston in contact with the drill bit.

Figure 4:
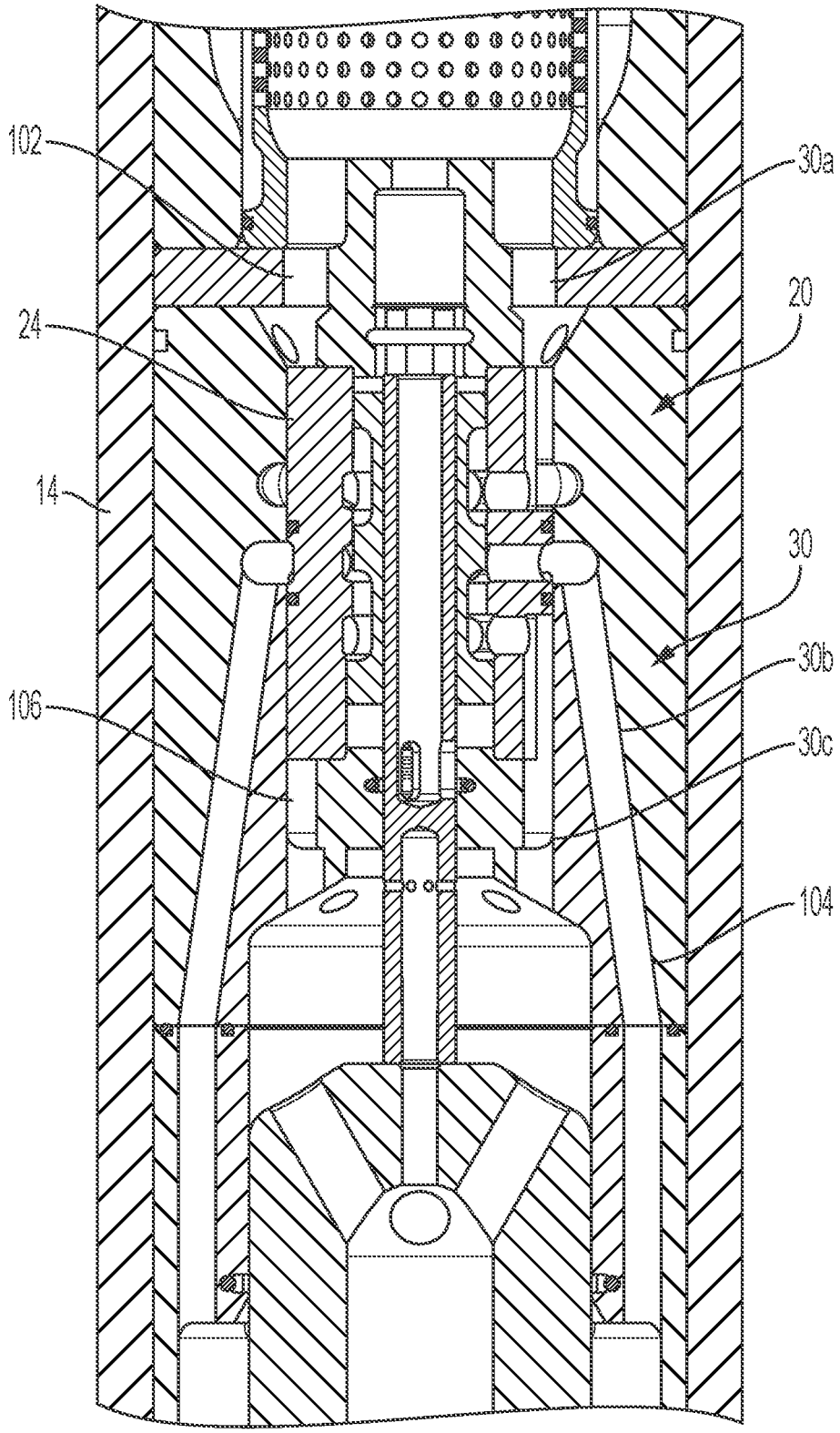
FIG. 4 is an enlarged cross-sectional view of a control valve assembly of the down-the-hole-drill hammer of FIG. 1.
Figure 5:
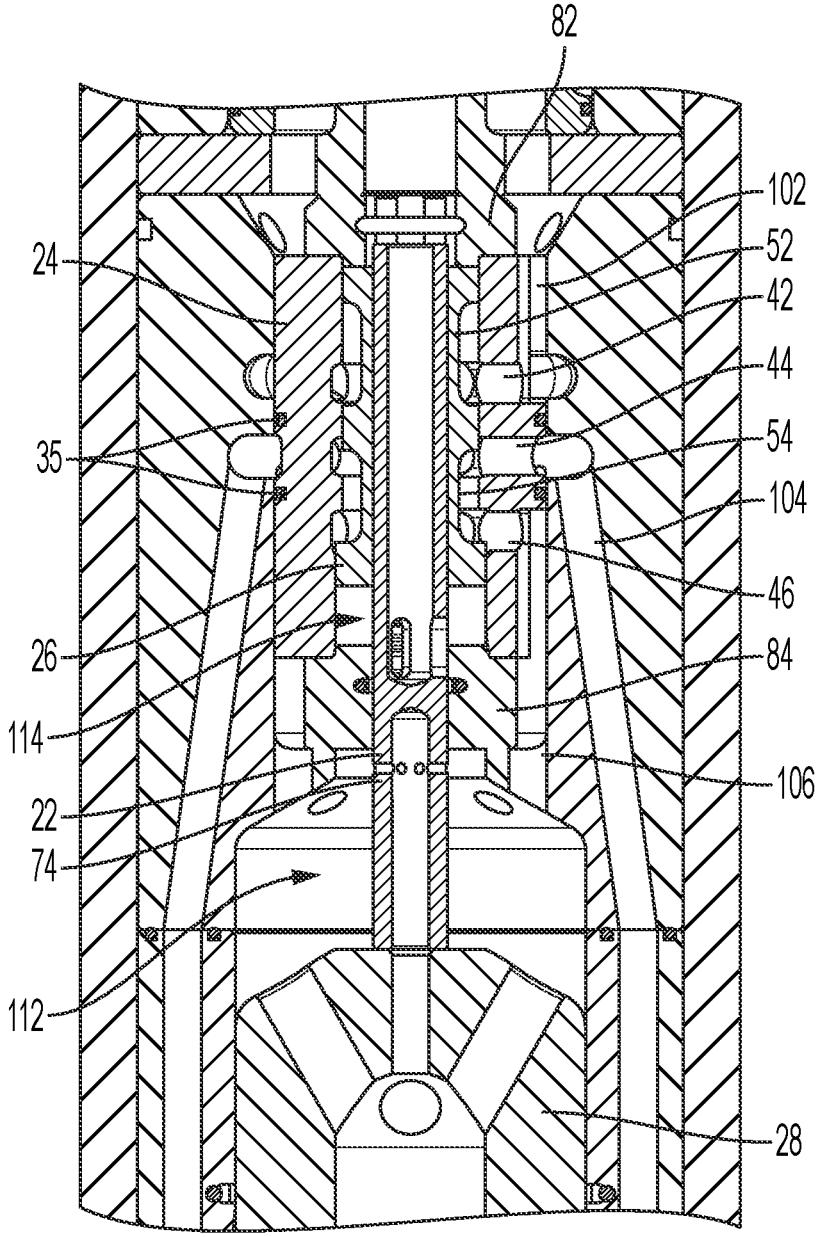
FIG. 5 is another enlarged cross-sectional view of a control valve assembly of the down-the-hole-drill hammer of FIG. 1 in a return stroke configuration.
Figure 6:
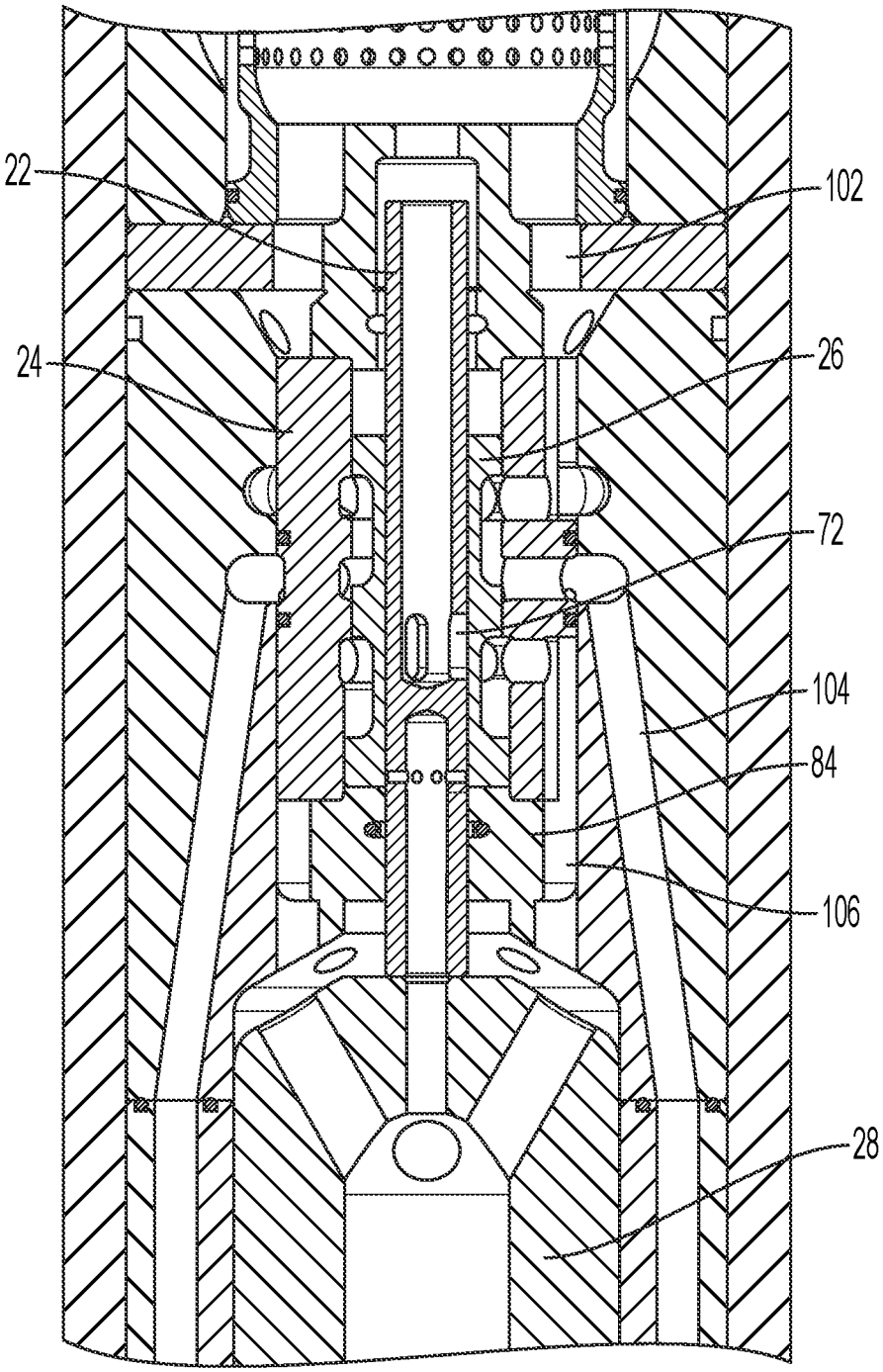
FIG. 6 is another enlarged cross-sectional view of a control valve assembly of the down-the-hole-drill hammer of FIG. 1 in a drive stroke configuration.

As best shown in FIGS. 4-6, the valve assembly 20 is located about a proximal end of the housing and above the piston. The valve assembly is in operative fluid communication with a porting assembly 30 of the drill hammer. The porting assembly 30 is a plurality of porting conduits 30*a-x* that allow for working fluids to be supplied to the drill hammer and exhausted from the drill hammer during operations. The valve housing 24 is mounted within the housing e.g., mounted within the porting assembly, in a fixed position with its various galleries in fluid communication with various porting conduits.

The valve housing 24 is configured as best shown in FIGS. 5-8 and includes a central through hole 32 for receiving the control valve 26 therein. The central through hole 32 is coaxial with a central longitudinal axis of the valve housing. The valve housing 24 includes external annular galleries 34*a*, 34*b* and 34*c* i.e., a plurality of galleries along it outer surface, which are configured for fluid communication with the porting assembly, as further discussed below. The external annular galleries are also in fluid communication with the central through hole 32, which is e.g. an internal central through hole or a central longitudinal through hole. Referring to FIG. 5, the valve housing also includes one or more seals 35 for sealing against an inner wall of the porting assembly and providing a seal between the various galleries 34*a-c*.

Figure 7:
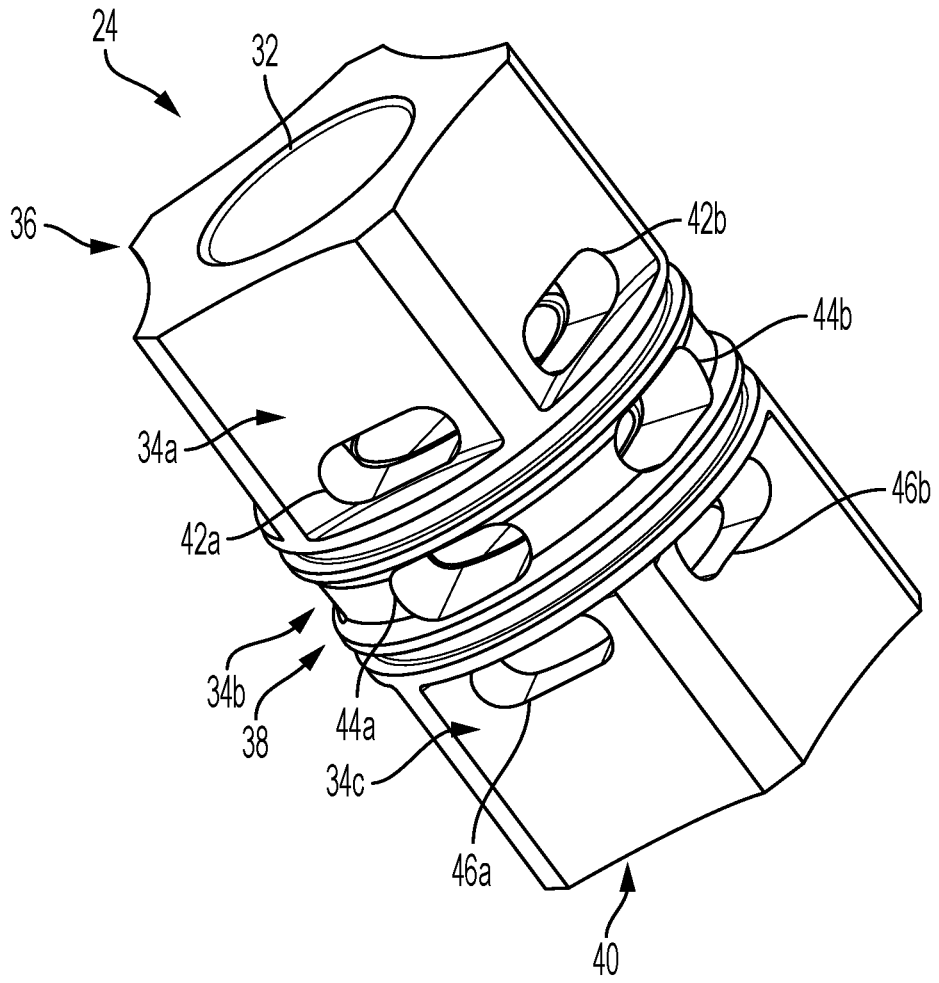
FIG. 7 is a perspective view of a valve housing for a down-the-hole drill hammer in accordance with an exemplary embodiment of the subject disclosure.

Referring to FIG. 7, the valve housing 24 includes proximal end portion 36 having a substantially pentagram-shaped longitudinal cross-section that extends to about a mid-portion 38 of the valve housing. The mid-portion 38 of the valve housing is configured to have a substantially circular longitudinal cross-section. A distal end portion 40 of the valve housing is also configured to have a substantially pentagram-shaped longitudinal cross-section. While the present exemplary embodiment is configured with a substantially pentagram-shaped longitudinal cross-section, the cross-sectional shape can alternatively be any other shape suitable for its intended purpose.

The proximal end portion 36 includes a plurality of through holes 42*a-e* circumferentially spaced apart and in fluid communication with the central through hole 32 and external gallery 34*a*. In the present example, the proximal end portion includes 5 through holes, but can alternatively include more or less e.g., 1, 2, 3, 4, 6, 7, 8, 9, 10 or more through holes. The mid-portion 38 includes a plurality of through holes 44*a-e* circumferentially spaced apart and in fluid communication with the central through hole 32 and external gallery 34*b*. In the present example, the mid-portion includes 5 through holes, but can alternatively include more or less e.g., 1, 2, 3, 4, 6, 7, 8, 9, 10 or more through holes. The distal end portion 40 includes a plurality of through holes 46*a-e* circumferentially spaced apart and in fluid communication with the central through hole 32 and external gallery 34*c*. In the present example, the distal end portion includes 5 through holes, but can alternatively include more or less e.g., 1, 2, 3, 4, 6, 7, 8, 9, 10 or more through holes.

Figure 8:
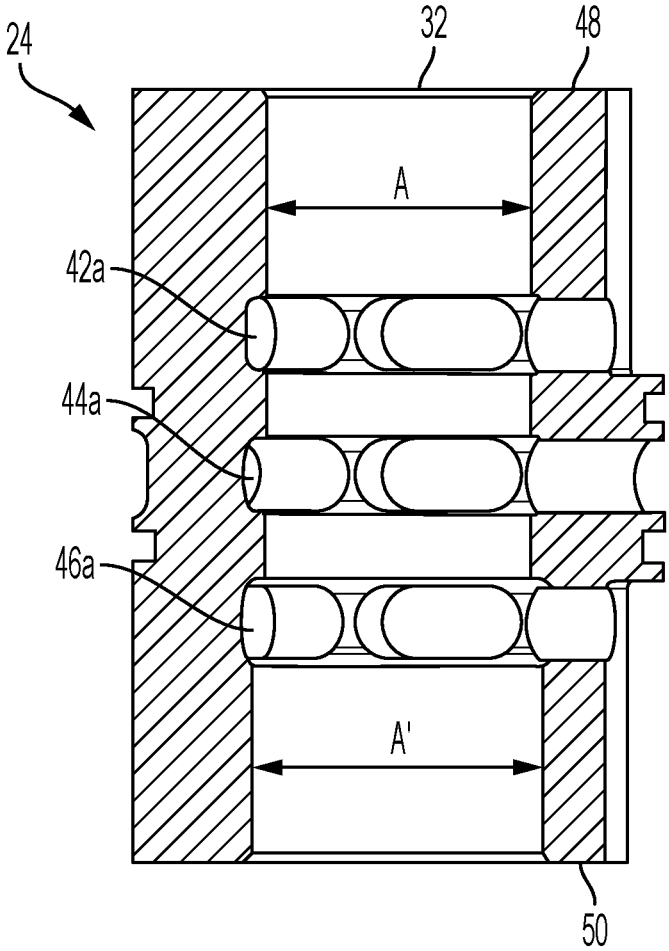
FIG. 8 is cross-sectional view of the valve housing of FIG. 7.

Referring to FIG. 8, the valve housing 24 has a proximal end face or supply face 48 and a distal end face or control face 50. The central through hole 32 extending through the proximal end portion 36 has an inner diameter A that is smaller than an inner diameter A' of the distal end portion 40. That is, the distal end face of the valve housing has a larger diameter through hole than the diameter of the through hole at the proximal end face. The diameter of the central through hole 32 remains constant through the proximal end portion and the mid-portion of the valve housing.

Figure 9:
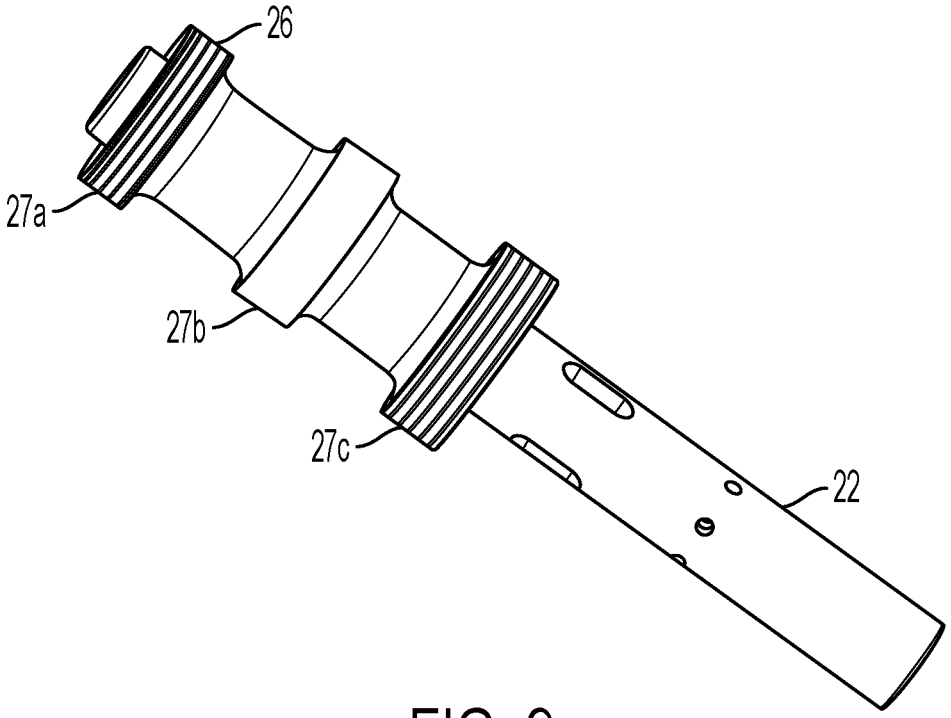
FIG. 9 is a perspective view of a control valve assembled to a piston follower valve for a down-the-hole drill hammer in accordance with an exemplary embodiment of the subject disclosure.
Figure 10:
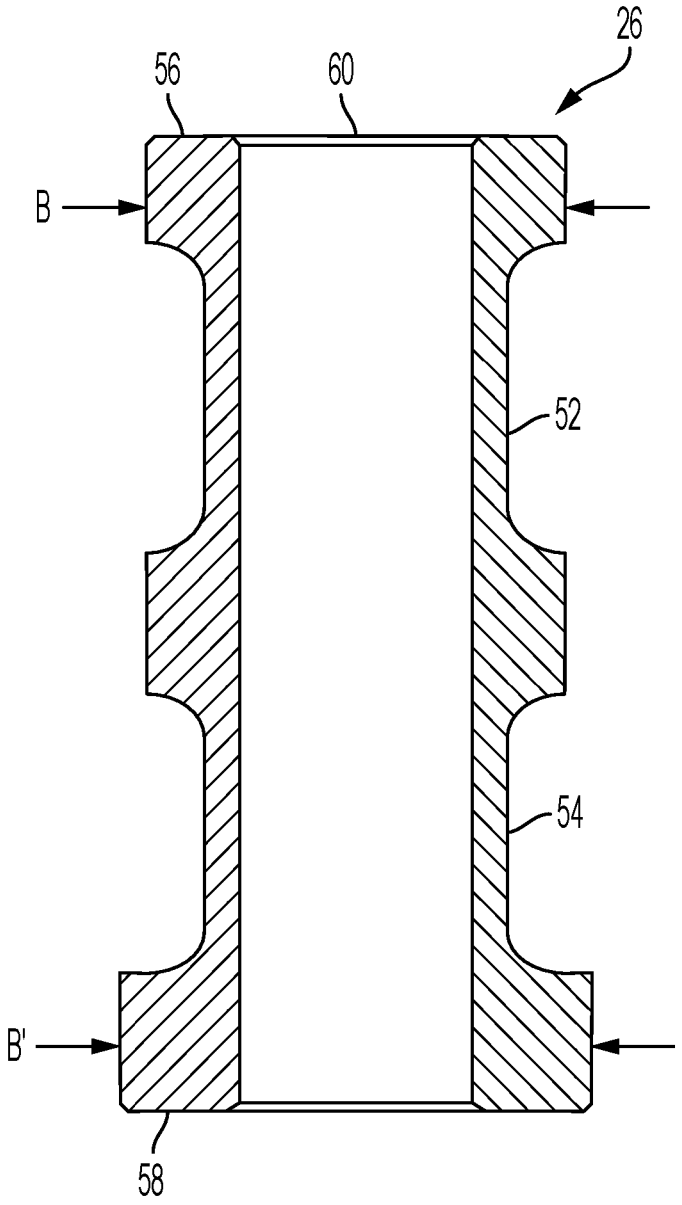
FIG. 10 is cross-sectional view of the control valve of FIG. 9.

The control valve 26 is configured as best shown in FIGS. 4, 9 and 10, and includes axially spaced annular galleries 52, 54, e.g., first gallery 52 and second gallery 54. Each annular gallery can be configured as an annular recess on the outer wall of the control valve and are axially space apart along a longitudinal length of a longitudinal axis of the control valve. That is, the first gallery is spaced from the second gallery. Each annular gallery is configured for fluid communication with respective galleries of the valve housing, as further discussed below. Annular gallery 52 is also sized to have a substantially same overall volume and overall axial length as annular gallery 54. A central through hole 60 extends through the control valve and is coaxial with a central longitudinal axis of the control valve. The central through hole 60 is sized to receive the piston follower valve 22 therein such that the piston follower valve can move or slide within the central though hole. The galleries are bounded by a proximal flange 27*a*, a medial flange 27*b*, and a distal flange 27*c*.

The overall diameter of the control valve 26 is sized and configured to move or slide within the valve housing 24. The control valve itself has two end faces, a proximal end face 56 and a distal end face 58 which differ in overall diameter. The proximal end face 56 is proximally facing or supply facing (i.e., facing the supply fluid entering the drill hammer) and has an overall diameter B that is smaller than an overall diameter B' of the distal end face 58 which is a distally facing end or alternatively referred to as a control face. The overall diameter B of the control valve remains constant throughout the length of the control valve except at the distal end face 58. In other words, the distal end face 58 includes a radially extending flange having an overall diameter B' that is greater than the overall diameter of the remainder of the control valve. The overall length i.e., the overall axial length, of the control valve is smaller than an overall length of the valve housing. In other words, the overall length i.e., the overall axial length of the valve housing is larger than an overall length of the control valve.

Figure 11:
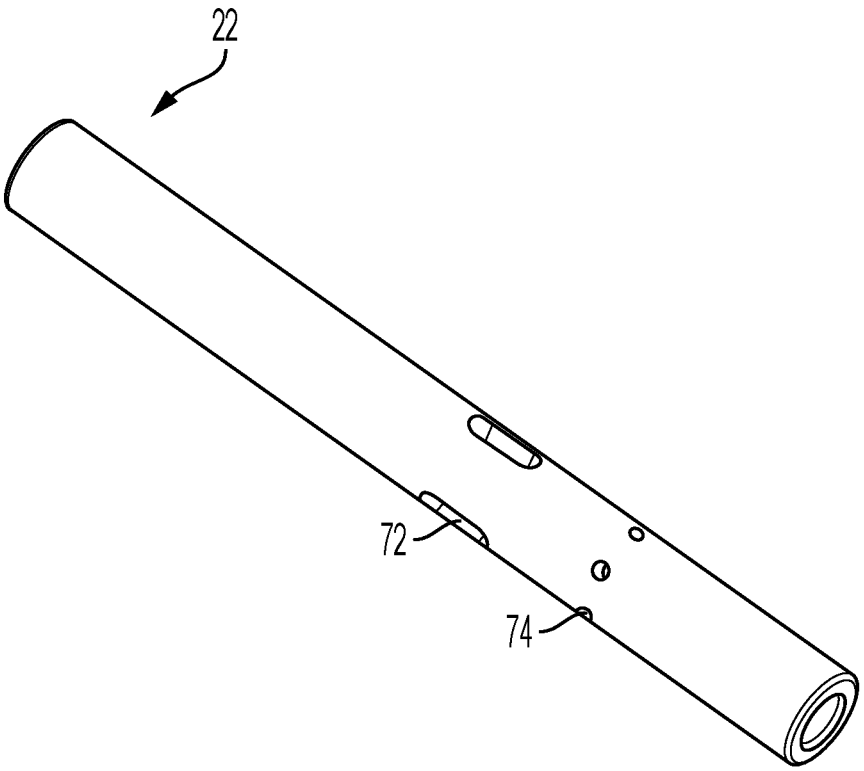
FIG. 11 is a perspective view of a piston follower valve for a down-the-hole drill hammer in accordance with an exemplary embodiment of the subject disclosure.
Figure 12:
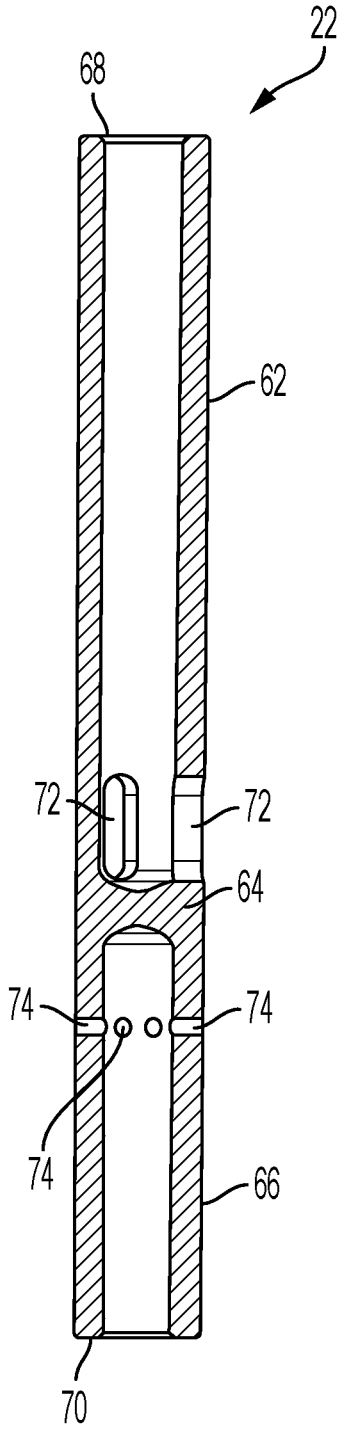
FIG. 12 is a cross-sectional elevational view of the piston follower valve of FIG. 11 a piston of the down-the-hole-drill hammer of FIG. 1.

The PFV 22 is configured as best shown in FIGS. 9, 11 and 12 and has a generally cylindrical overall shape. In other words, the PFV is a cylindrical valve. The PFV has a first annular portion 62 occluded at about a midportion via an occlusion 64 and a second annular portion 66. The first annular portion 62 has an open proximal face 68 and the second annular portion has an open distal face 70. Adjacent a proximal side of the occlusion 64, the first annular portion 62 includes a plurality of slots 72 circumferentially spaced apart and in fluid communication with an interior of the first annular portion. The plurality of slots 72 are positioned adjacent the occlusion 64. Adjacent a distal side of the occlusion 64, the second annular portion 66 includes a plurality of through holes 74 circumferentially spaced apart and in fluid communication with an interior of the second annular portion. The PFV is sized and configured to move or slide within the control valve 26. Consequently, the PFV is configured to move relative to the valve housing 24. The PFV includes an overall length i.e., an overall longitudinal axial length, that is greater or larger than an overall length of the valve housing 24 and the control valve 26. The overall diameter of the PFV is configured to be constant throughout its entire axial length.

Referring back to FIGS. 2 and 3, the overall components of the drill hammer 10 are illustrated. The drill hammer 10 includes the housing 14, the back head 16, a drive chamber 76, a distributor 78, the porting assembly 30, the piston 28, a seal 80, and the drill bit 18. The valve assembly 20 is mounted within and collectively forms the distributor 78, which is in operative fluid communication with the porting assembly 30.

The porting assembly 30 is a series of ports or fluid passageways for the passage of working fluids through the drill hammer to drive percussive operation thereof. In the present exemplary embodiment, the porting assembly includes a supply inlet 100, supply ports 102, drive ports 104, and exhaust ports 106 (FIGS. 2 and 5). The supply inlet 100 feeds the supply ports 102 and the PFV 22. The supply ports 102 receive supply from the supply inlet and feeds the working fluid to the distributor 78. The drive ports 104 supply drive pressures to the piston and the exhaust ports 104 provide exhaust passageways to exhaust working fluids from the drill hammer. For example, the drive ports 104 allow supply to feed a drive volume 108 which drive movement of the piston via a piston drive shoulder 110.

The valve assembly 20 is mounted within the drill hammer as best shown in FIGS. 5 and 6. FIG. 5 illustrates the valve assembly when moved to a return stroke configuration or first position associated with movement of the piston during its return stroke. FIG. 6 illustrates the valve assembly when moved to a drive stroke configuration or second position associated with movement of the piston during its drive stroke. The valve housing 24 is fixed in position (i.e., the valve housing remains in a stationary position within the drill hammer) within the distributor via mounts 82 and 84 having its annular gallery 34*a* in fluid communication with the supply port 102, its annular gallery 34*b* in fluid communication with the drive port 104 and its annular gallery 34*c* in fluid communication with the exhaust port 106. Each of the valve housing's annular galleries are in fluid communication with the valve housing's internal volume via respective through holes 42, 44 and 46.

FIG. 5 illustrates the control valve 26 mounted within the valve housing 24. The smaller diameter proximal end of the control valve is configured to move or slide along the smaller diameter central through hole of the proximal end of the valve housing while the larger diameter distal end of the control valve is configured to move or slide along the larger diameter central through hole of the distal end of the valve housing. The overall length of the control valve and spacing of the first and second galleries 52, 54 of the control valve are configured to allow the first gallery 52 to be in either fluid communication with the supply port 102 only or in fluid communication with both the supply port 102 and the drive port 104 depending upon its position within the valve housing 24, and for the second gallery 54 to be in either fluid communication with the exhaust port 106 only or in fluid communication with both the exhaust port 106 and the drive port 104 depending upon its position within the valve housing 24.

In the return stroke configuration (FIG. 5), the control valve 26 is moved to an uppermost position within the valve housing 24. The position of the control valve 26 is limited or stopped by mount 82. In this position, the first gallery 52 of the control valve is in fluid communication with the supply inlet and the second gallery 54 is in fluid communication with the drive port 104 and exhaust port 106. The PFV 22 is also moved upwardly (as shown in FIG. 5) or proximally as the piston moves upwardly (as shown in FIG. 5) or proximally. During this stoke or movement of the PFV, the PFV's slots 72 move into fluid communication with a valve control area 114 and supply feed from the supply inlet then feeds the valve control area 114 moving the control valve to the uppermost position. Once the PFV moves sufficiently upwardly such that the through holes 74 are occluded by the mount 84 working fluids within the drill hammer including working fluid withing a return chamber 112 are exhausted out of the drill hammer via the porting assembly. When the through holes 74 move past the mount 84 the through holes 74 allow for working fluid within the valve control area 114 to bleed to low pressures thereby allowing movement of the control valve back distally or downwardly (as shown in FIG. 5). The control valve 26 is also positioned to allow fluid communication between the drive ports 104 and exhaust ports 106. It is at this point that the control valve starts to move to the drive stroke configuration, as shown in FIG. 6.

In the drive stroke configuration (FIG. 6), the control valve 26 is moved to a most bottom or distal position and limited or stopped by mount 84 owing to the slots 72 of the PFV being occluded by the control valve body and supply from the supply inlet. In this position, the control valve's gallery allows fluid communication between the supply port 102 and the drive port 104 such that supply fluid can be supplied to the drive volume 108 to drive the stroke of the piston. During the drive stroke, the piston moves downwardly (as shown in FIG. 6) or distally to impact the drill bit. In sum, the valve housing's plurality of galleries enable the control valve 26 to direct working fluid to supply or exhaust depending on the position of the control valve therein.

In operation, working fluid is supplied to the drill hammer through supply inlet and the supply side or proximal end of the valve assembly is always pressurized to provide a force to push the control valve and PFV distally or downwardly towards the drill bit end of the hammer. The distal end or control side of the valve assembly is alternatingly supplied by supply or exhaust pressure fluid. When the piston moves downwardly, working fluid pressures pass through the supply ports and drive ports and through the valve housing. When the piston moves upwardly, exhaust pressures pass through the valve housing and the exhaust ports.

The PFV is free to move independently of the piston, i.e., the PFV is unconnected to the piston. However, owing to the supply pressures and motion of the piston, the PFV is moved in part by the piston and supply pressures during operation of the hammer and thereby "follows" the piston. The PFV is designed to allow valve porting based on piston position. Further, the volume at the proximal end of the piston where PFV contacts the piston is always exposed to exhaust pressure. The piston follower valve is movable relative to the piston and is moveable relative to the valve housing and the control valve. Additionally, the piston follower valve is movable between a first position wherein the plurality of slots is occluded and second position wherein the plurality of slots are not occlude and in fluid communication an external of the piston follower valve. Further, the piston follower valve is movable between a first position wherein the plurality of through holes is occluded and second position wherein the plurality of through holes are not occlude and in fluid communication an external of the piston follower valve.

In the drive stroke phase, supply pressure moves the control valve distally within the valve housing. Then, as the PFV moves downwardly, the PFV slots communicate with the valve control area thereby filling the valve control area with supply pressure and moving the control valve upwardly, and then the cycle repeats. The distally facing end of the control valve defining the valve control area is larger than the proximally facing end of the control valve. During the return phase, when the PFV moves upwardly the PFV slots become occluded by the control valve and the PFV through holes fluidly connect with the valve control area exhausting the pressures within the valve control area thereby allowing the supply pressure to move the control valve back downwardly. This movement of the PFV, which follows movement of the piston, thereby controls positioning of the control valve and pressures applied to the piston via the drive ports and exhaust ports.

Referring back to FIG. 3, the lower end of the PFV is shown in contact with the top of the piston. The piston has two working areas. The smaller of the working areas (return area) 107 about a lower end or distal end of the piston is always pressurized with supply fluid. The larger working area (drive area) 108 about an upper end or proximal end of the piston is alternatingly supplied with supply pressure and exhaust pressure to drive the piston down and up, respectively, into and out of percussive contact with the drill bit. That is, when the drive area is ported to exhaust, the piston moves upwardly or proximally, and when the drive area is ported to supply the piston moves downwardly or distally.

In accordance with another exemplary embodiment, the present disclosure provides for a valve assembly for a down the a down-the-hole drill hammer that includes a valve housing, a control valve mounted within and movable relative to the valve housing, and a piston follower valve moveable relative to the valve housing and control valve. The valve assembly can be e.g., the valve assembly 20 as described above.

It will be appreciated by those skilled in the art that changes could be made to the various aspects described above without departing from the broad inventive concept thereof. It is to be understood, therefore, that the subject application is not limited to the particular aspects disclosed, but it is intended to cover modifications within the spirit and scope of the subject application as defined by the appended claims.

What is claimed is:

1. A down-the-hole drill hammer comprising:
a drill bit;
a piston for percussively contacting the drill bit; and
a valve assembly for controlling the supply of drive fluid to and from the piston, the valve assembly comprising:
a control valve moveable within the valve assembly, and
a piston follower valve moveable within the control valve independently from the piston.

2. The down-the-hole drill hammer of claim 1, wherein the valve assembly further includes a valve housing.

3. The down-the-hole drill hammer of claim 2, wherein the valve housing is mounted within a valve control area and the control valve and piston follower valve are each movable relative to the valve housing.

4. The down-the-hole drill hammer of claim 2, wherein the valve housing includes galleries configured for fluid communication with supply ports, drive ports and/or exhaust ports.

5. The down-the-hole drill hammer of claim 2, wherein the valve housing includes a central through hole having an upper end portion distal the piston and a lower end portion proximal the piston, and wherein the lower end portion has a larger internal diameter than an internal diameter of the upper end portion.

6. The down-the-hole drill hammer of claim 2, wherein the valve housing includes a plurality of galleries along its outer surface in fluid communication with an internal central through hole.

7. The down-the-hole drill hammer of claim 2, wherein the valve housing includes at least three through holes spaced apart in a longitudinal direction along a longitudinal length of the valve housing.

8. The down-the-hole drill hammer of claim 2, wherein the control valve includes galleries configured for fluid communication with valve housing galleries.

9. The down-the-hole drill hammer of claim 2, wherein the control valve includes a first gallery and a second gallery spaced from the first gallery.

10. The down-the-hole drill hammer of claim 2, wherein the control valve includes a longitudinal through hole coaxial with a longitudinal axis of the control valve.

11. The down-the-hole drill hammer of claim 1, wherein the control valve includes a distal end face having an overall diameter larger than a proximal end face.

12. The down-the-hole drill hammer of claim 1, wherein the piston follower valve is movable relative to the piston.

13. The down-the-hole drill hammer of claim 1, wherein the piston follower valve is movable relative to a valve housing.

14. The down-the-hole drill hammer of claim 1, wherein the piston follower valve is a cylindrical valve.

15. The down-the-hole drill hammer of claim 1, wherein the piston follower valve includes a first annular portion occluded at about a midportion via an occlusion and a second annular portion.

16. The down-the-hole drill hammer of claim 15, wherein the first annular portion includes a plurality of slots circumferentially spaced apart and in fluid communication with an interior of the first annular portion.

17. The down-the-hole drill hammer of claim 16, wherein the piston follower valve is movable between a first position wherein the plurality of slots is occluded and a second position wherein the plurality of slots is not occluded and in fluid communication an external of the piston follower valve.

18. The down-the-hole drill hammer of claim 15, wherein the second annular portion includes a plurality of through holes circumferentially spaced apart and in fluid communication with an interior of the second annular portion.

19. The down-the-hole drill hammer of claim 18, wherein the piston follower valve is movable between a first position wherein the plurality of through holes is occluded and a second position wherein the plurality of through holes is not occluded and in fluid communication an external of the piston follower valve.

* * * * *